US006769156B1

(12) United States Patent
Chen

(10) Patent No.: US 6,769,156 B1
(45) Date of Patent: Aug. 3, 2004

(54) ZIPPER HAND WITH PULLER FIXED FUNCTION

(76) Inventor: Tan Ming Chen, No. 165, Lane 256, Sec. 2, Chung Shan N. Rd., Tao Yuan Hsien (TW)

( * ) Notice: Subject to any disclaimer, the term of this patent is extended or adjusted under 35 U.S.C. 154(b) by 0 days.

(21) Appl. No.: 10/424,913

(22) Filed: Apr. 29, 2003

(51) Int. Cl.[7] ..... A44B 19/30

(52) U.S. Cl. ..... 24/421; 24/419; 24/424; 24/428; 24/429

(58) Field of Search ..... 24/421, 424, 428, 24/429, 419, 437; 70/68

(56) References Cited

U.S. PATENT DOCUMENTS 2,324,788 A * 7/1943 Marinsky ..... 24/421
3,955,842 A * 5/1976 Edwards ..... 292/307 R
5,896,628 A * 4/1999 Oda ..... 24/421
6,209,176 B1 * 4/2001 Anscher ..... 24/429
6,332,249 B1 * 12/2001 Oda et al. ..... 24/421
6,647,598 B2 * 11/2003 Lin ..... 24/421
6,654,988 B1 * 12/2003 Chung ..... 24/421

* cited by examiner

*Primary Examiner*—Victor Sakran
(74) *Attorney, Agent, or Firm*—Rosenberg, Klein & Lee

(57) ABSTRACT

A zipper hand with puller fixed function includes a body, a hook element, a connected element, a puller and a buckled means, wherein the hook element is disposed on the body, one end of the hook element has a hook portion inserted into two guiding grooves of the body, one end of the connected element is connected to a top of the body and contacted to an inner edge of the hook element, the puller is connected to the connected element, and the buckled is disposed between the body and the puller. When the zipper hand is in a buckled state, the puller can be buckled and fixed on the body, and do not worry about the puller is raised up, so as to maintain the zipper hand in the buckled state, for avoiding the zipper hand being loosed and occurring an unexpected move.

9 Claims, 8 Drawing Sheets

ZIPPER HAND WITH PULLER FIXED FUNCTION

FIELD OF THE INVENTION

The present invention relates to a zipper hand with puller fixed function, especially to a self-locking zipper hand which can fix the puller on a body thereof, and do not worry about the puller is raised up, so as to ensure the zipper hand to maintain the buckled state.

BACKGROUND OF THE INVENTION

Referring now to FIG. 1, a zipper hand of the prior art includes a body 100, a hook element 200 and a puller 300, wherein the body 100 has two guiding grooves 101, the two guiding grooves 101 can receive the zipper 400, the hook element 200 is made of an elastic metal material and received in the body 100, the hook element 200 has a hook portion 201 inserted into the guiding groove 101 of the body 100, for buckling the hook element 200 on a chain of the zipper 400 and getting the buckled function; whereby, when the puller 300 do not move yet and in a buckled state, so as to form a self-locking zipper hand. The puller 300 is pivoted on a top of the body 100, and the pivotal shaft 301 of the puller 300 is contacted with an inner edge of the hook element 200, hence when the puller 300 is pulled up, it can be moved upwardly with the hook portion 201 of the hook element 200 and separated from the zipper 400 of the guiding groove 101, to make the zipper hand can smoothly move on the zipper 400 for controlling the zipper 400 to be combined or separated.

However, even if the zipper hand of the prior art is in a buckled state, the puller still probably be raised up by itself and moved non-carefully, so as to cause the hook portion 201 be separated from the guiding groove 101, and the zipper hand will be loosed and occur an unexpected move, so as to cause the separation of the zipper, especially to a zipper hand which installed on the shoe, it will generate more serious question due to above.

SUMMARY OF THE INVENTION

The primary object of the present invention is to provides a zipper hand with puller fixed function, when the zipper hand is in a buckled state, the puller can be buckled and fixed on the body, and do not worry about the puller is raised up, so as to maintain the zipper hand in the buckled state, for avoiding the zipper hand being loosed and occurring an unexpected move.

In order to achieve the above objects, the present invention provides a zipper hand with puller fixed function including a body having two guiding grooves, a hook element disposed on the body, and the hook element having a hook portion at an end thereof and inserted into the guiding groove of the body, a connected element having one end connected to a top of the body and contacted with an inner edge of the hook element, a puller connected to the connected element; and a buckled means disposed between the body and the puller, for buckling and fixing the puller on the body.

The various objects and advantages of the present invention will be more readily understood from the following detailed description when read in conjunction with the appended drawing, in which:

DETAILED DESCRIPTION OF THE PREFERRED EMBODIMENT

Figure 1:
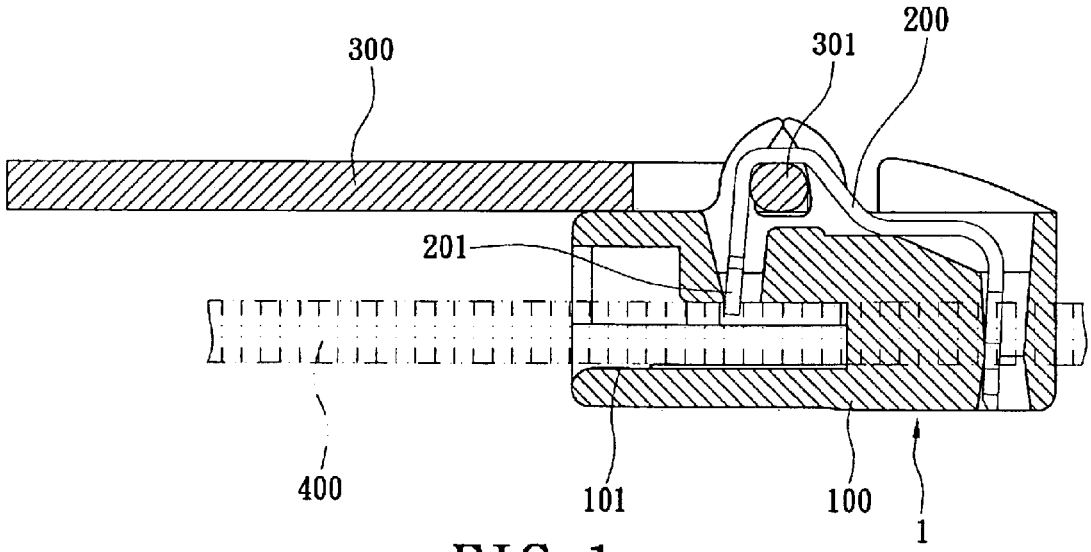
FIG. 1 PRIOR ART
FIG. 1 is a cross-section view of a zipper of the prior art invention.
Figure 2:
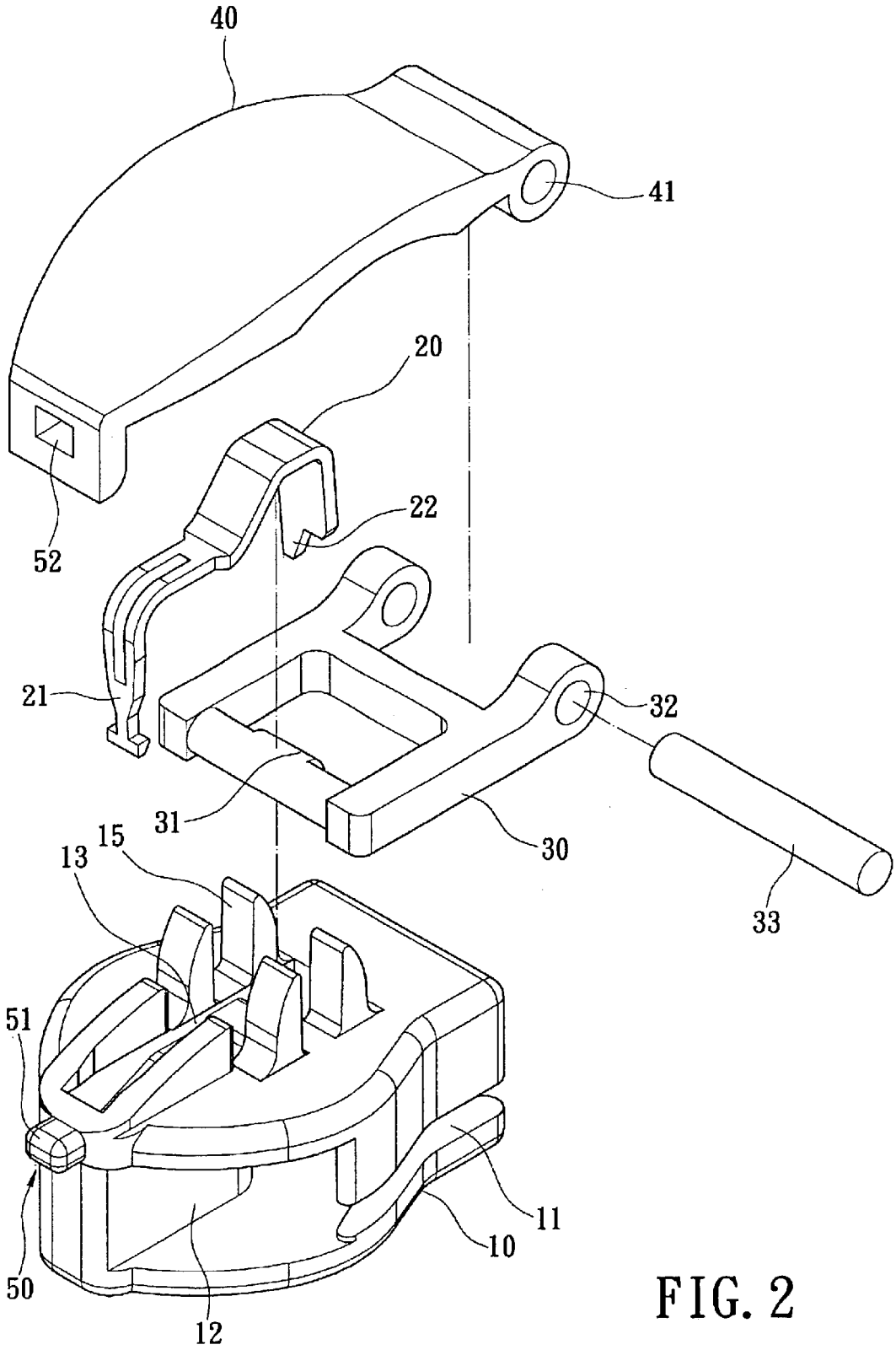
FIG. 2 is an exploded view of according to a first embodiment of the present invention.
Figure 3:
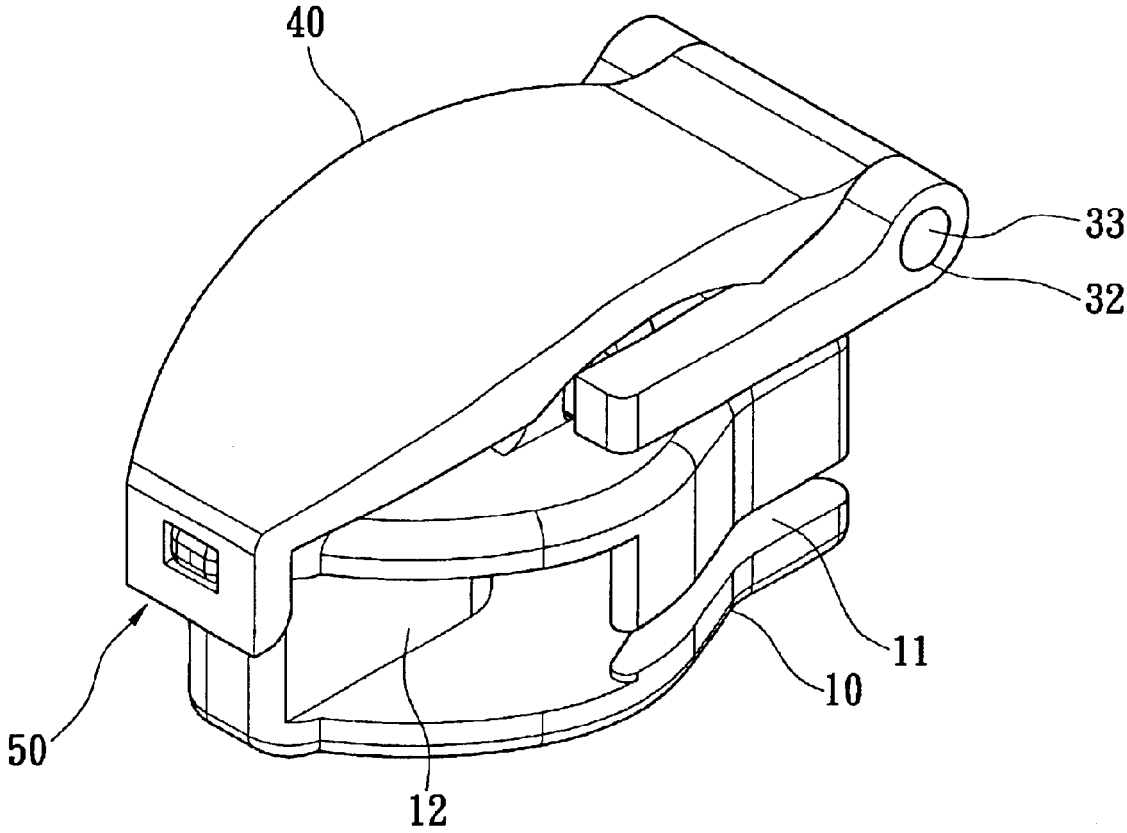
FIG. 3 is a perspective view of according to a first embodiment of the present invention.
Figure 4:
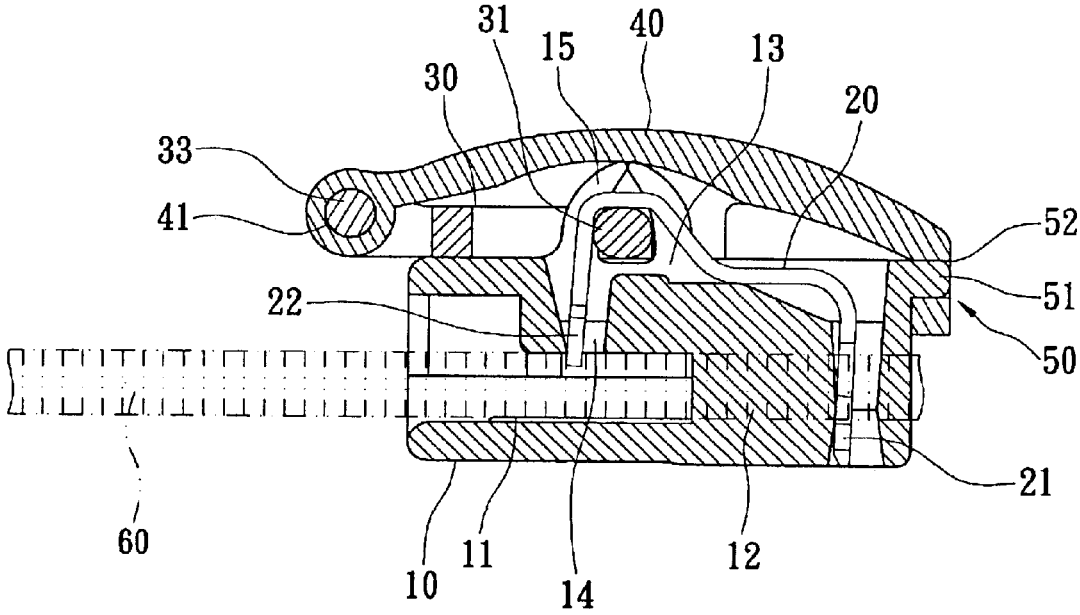
FIG. 4 is a cross-section view of according to a first embodiment of the present invention.

Referring now to FIG. 2, FIG. 3 and FIG. 4, the present invention provides a zipper hand with fixed function, and the zipper hand comprises a body 10, a hook element 20, a connected element 30, a puller 40 and a buckled means 50, wherein the body 10 is made of a metal or a plastic material, and the body 10 has two guiding grooves 11 and a baffler 12, the baffler 12 is disposed between the two guiding grooves 11, for separating the two guiding grooves. 11, the zipper 60 can be engage with the zipper hand through the two guiding grooves 11 (shown as the FIG. 4). And the body 10 has a receiving space 13 and a through hole 14 for receiving the hook element 20 (shown as the FIG. 4), the through hole 14 can receive a hook portion 22 of one end of the hook element 20, a top of the body 10 is formed two protruding pivotal seat 15 for pivoting the connected element 30 and the puller 40 thereon.

The hook element 20 is made of an elastic metal material, one end of the hook element 20 has a fulcrum 21, another end of the hook element 20 has a hook portion 22, the fulcrum 21 of the hook element 20 received in the through hole 13 of the body 10, and the hook portion 22 can insert into the guiding groove 11 of the body 10 and buckle on the chain of the zipper 60.

The connected element 30 is made of a metal or a plastic material, one end of the connected element 30 has a pivotal shaft 31 pivoted on the two pivotal seats 15 of the top of the body 10, so as to pivot the connected element 30 on the top of the body 10, and the pivotal shaft 31 of the connected element 30 contacting with an inner edge of the hook element 20, hence when the connected element 30 is pulled up, the hook portion 22 of the hook element 20 and the zipper 60 in the guiding groove 11 can be separated each other, and the one end of the connected element 30 has a first pin hole 32 for connecting the puller 40.

The puller 40 is made of a metal or a plastic material, a larger surface is formed on the puller 40, so that a word, a pattern or a trademark can arrange thereon, one end of the puller 40 has a second pin hole 41, the second pin hole 41 is oppositely disposed on the first pin hole 32 of the one end of the connected element 30, a pin element 33 is disposed through the first pin hole 32 and the second pin hole 41, so that the puller 40 use the pin-element 33 to-pivot on the one end of the connected element 30.

The buckled means 50 is disposed between the body 10 and puller 40, the buckled means 50 has a buckled body 51 disposed outside of one end of the body 10 and a buckled hole 52 is oppositely disposed on the one end of the puller 40, when the puller 40 do not use, the puller 40 can dispose on the hook element 20 and the connected element 30, and the buckled body 51 and the buckled hole 52 buckled each other, for buckling and fixing a free end of the puller 40 on the hook element 20 and the connected element 30, so that the present invention has come up with an innovated zipper with puller fixed function.

Figure 5:
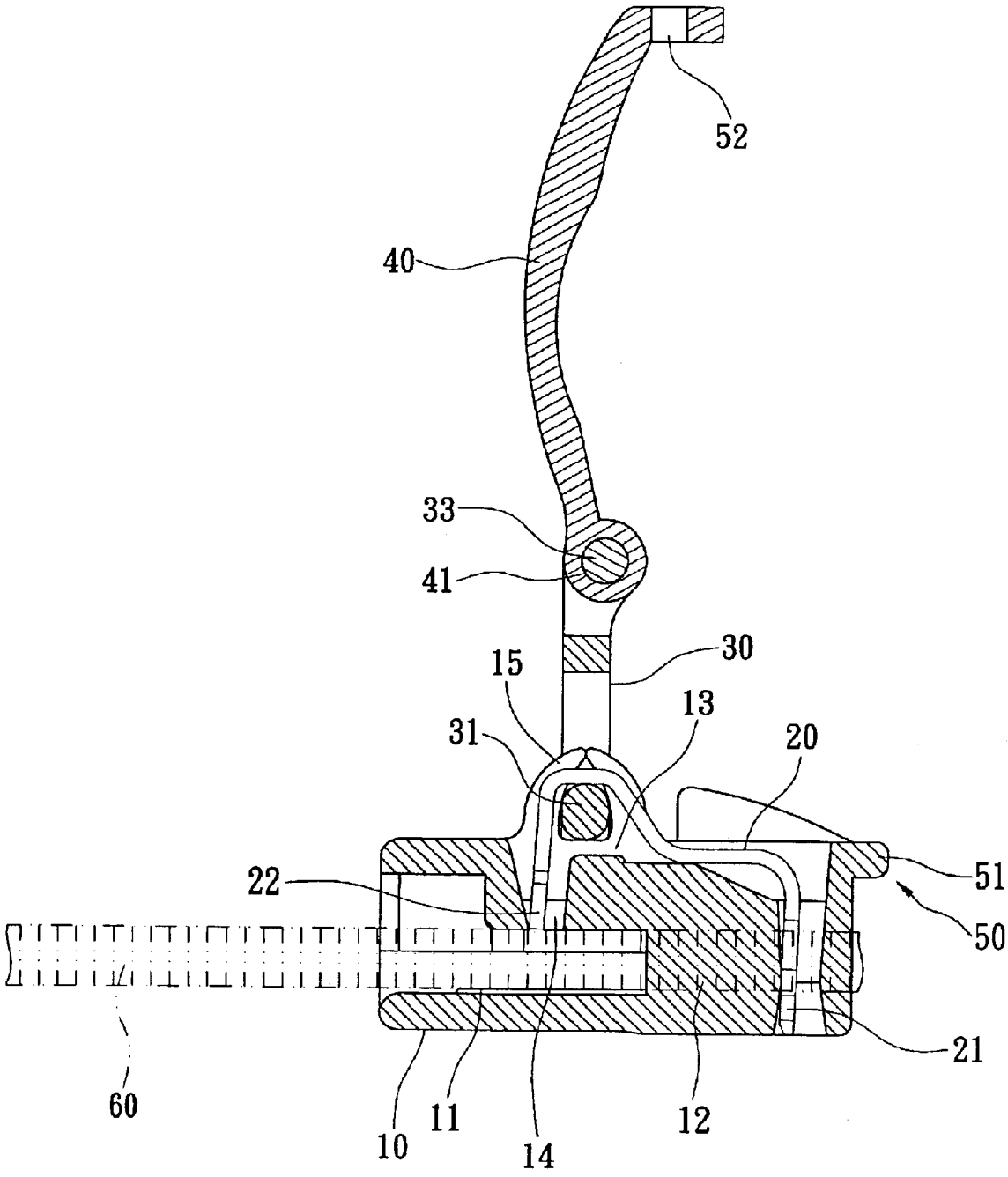
FIG. 5 is a cross-section view of when puller is pulled of according to a first embodiment of the present invention.

Because the hook portion 22 of the hook element 20 is inserted into the guiding groove 11 of the body 10 and buckled on the chain of the zipper 60, to make the zipper hand do not move and get the buckled function, in another word when the puller 40 is in a stop state, the zipper hand is in a buckled state, what is call self-locking zipper hand. And when the puller 40 is pulled (shown as the FIG. 5), the pivotal shaft 31 of the connected element 30 can contact the hook element. 20 to raise and move, for separating the hook portion 22 of the hook element 20 and the zipper 60 of the guiding groove 11, to make the zipper hand can smooth move on the zipper 60 for controlling the zipper 60 be combined or separated.

The present invention provides the buckled means 50 between the body 10 and the puller 40, when the puller 40 do not move yet, the zipper hand is in a buckled state for using the buckled means 50to buckle and fix the puller 40 on the body 10, so that the puller 40 disposed cover the hook element 20 and the connected element 30, for buckling and fixing the puller 40 on the body 10, and do not worry about the puller is raised up, so as to maintain the zipper in the buckled state, when the puller 40 or the connected element 30 is moved, the body 10 and the puller 40 will be separated.

Figure 6:
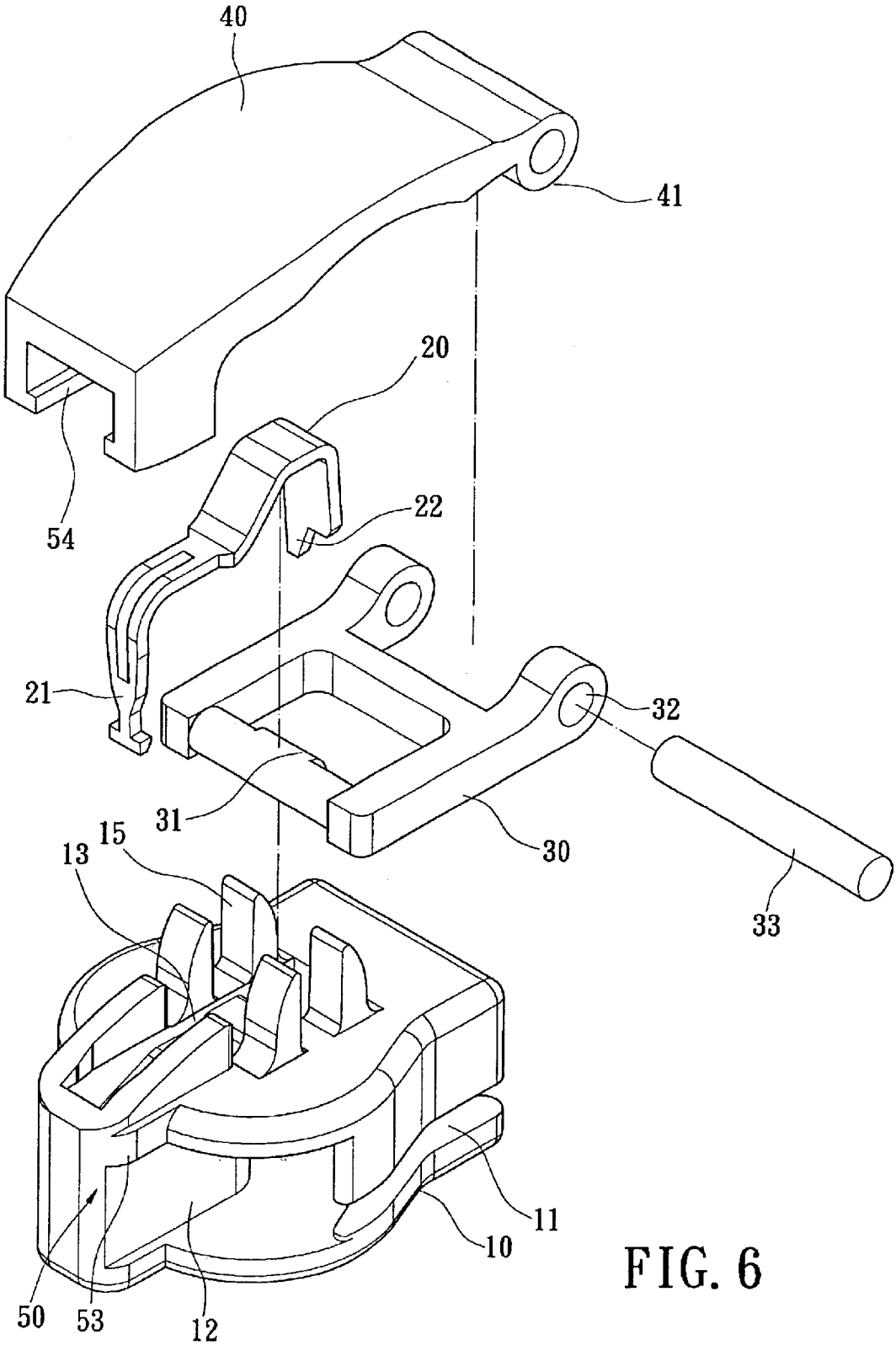
FIG. 6 is an exploded view of according to a second embodiment of the present invention.

Besides, referring now to FIG. 6, the buckled means 50 of the present invention also has different design, which includes a first projected buckle 53 disposed on two outside edge of the one end of the body 10 and a second projected buckle 54 oppositely disposed on two outside edge of the one end of the puller 40, the first projected buckle 53 and the second projected buckle 54 can buckle each other, for buckling and fixing the puller 40 on the body 10.

Figure 7:
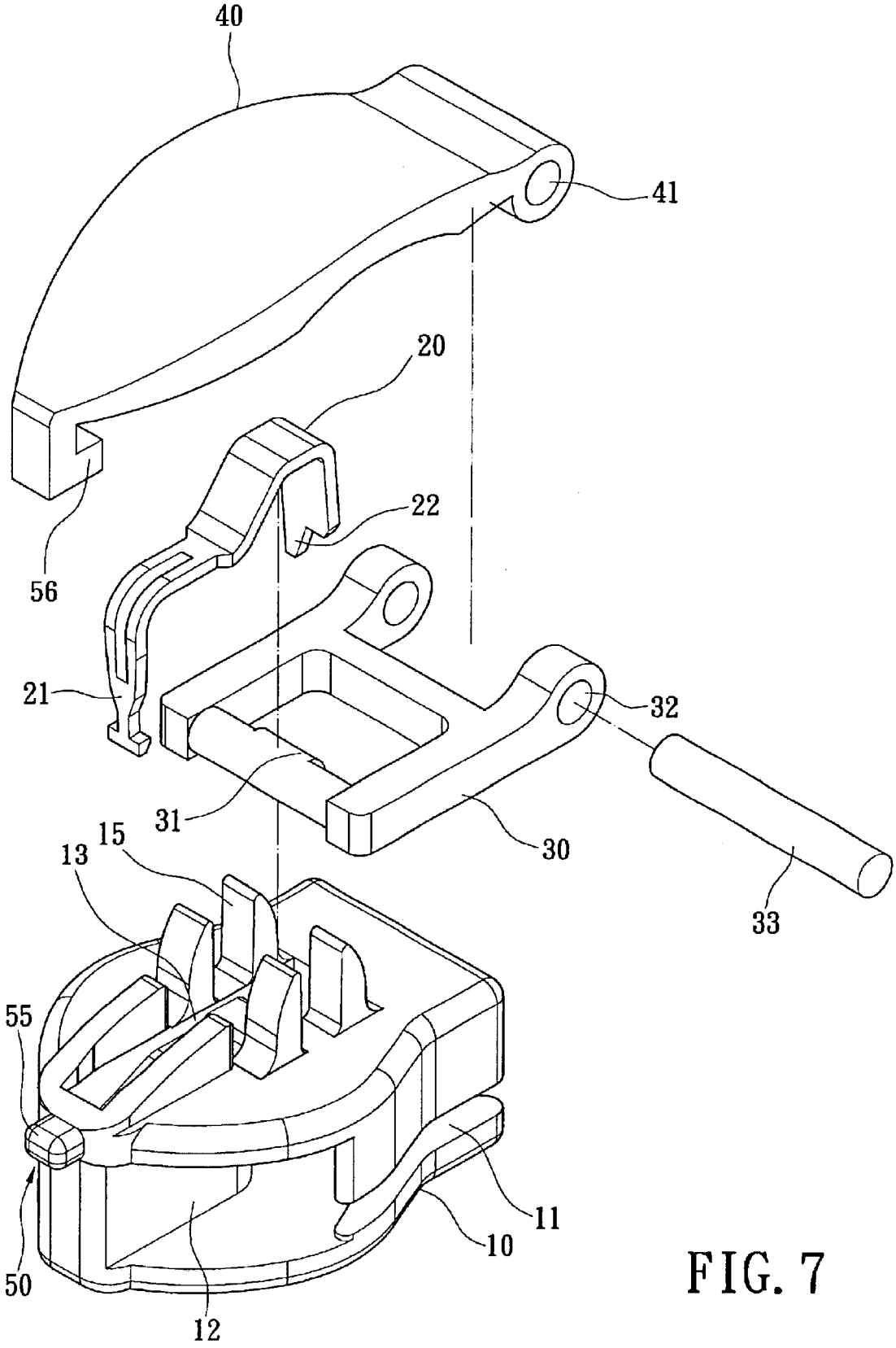
FIG. 7 is an exploded view of according to a third embodiment of the present invention.

Moreover, referring now to FIG. 7, the buckled means 50 of the present invention also has different design, which includes a first projected buckle 55 disposed on two outside edge of the one end of the body 10 and a second projected buckle 56 oppositely disposed on two outside edge of the one end of the puller 40, the first projected buckle 55 and the second projected buckle 56 can buckle each other; for buckling and fixing the puller 40 on the body 10.

Figure 8:
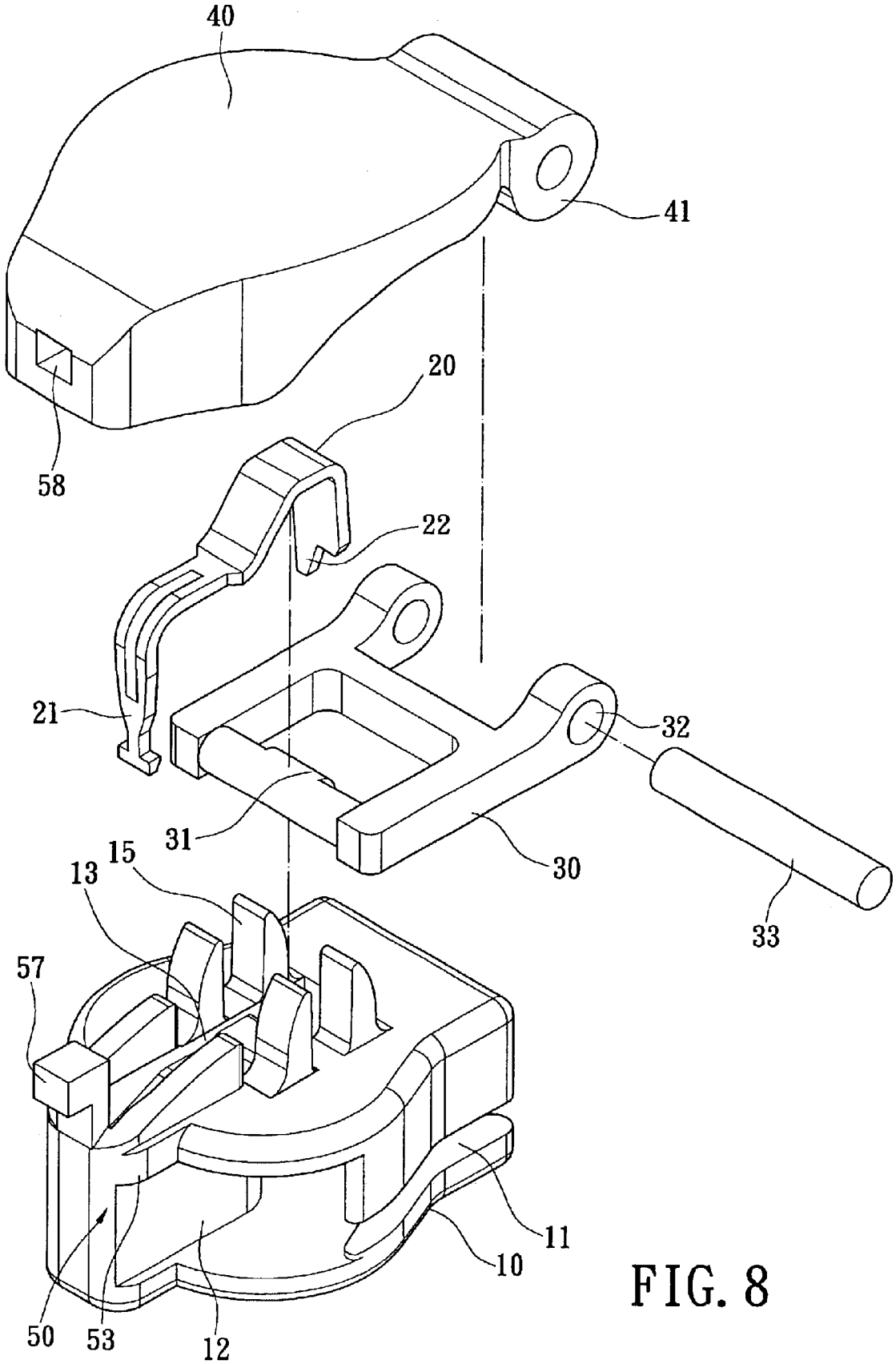
FIG. 8 is an exploded view of according to a fourth embodiment of the present invention.

Furthermore, referring now to FIG. 8, the buckled means 50 of the present invention also has different design, which includes a buckled body 57 disposed on two outside edge of the one end of the body 10 and a buckled hole 58 oppositely disposed on two outside edge of the one end of the puller 40, the buckled body 57 and the buckled hole 58 can buckle each other, for buckling and fixing the puller 40 on the body 10.

Although the present invention has been described with reference to the preferred embodiment thereof, it will be understood that the invention is not limited to the details thereof. Various substitutions and modification have suggested in the foregoing description, and other will occur to those of ordinary skill in the art. Therefore, all such substitutions and modifications are intended to be embraced within the scope of the invention as defined in the appended claims.

What is claimed is:

1. A zipper head with a puller fixed function comprising:

a body having two guiding grooves;

a hook element disposed on the body, and the hook element having a hook portion at an end thereof and inserted into the guiding groove of the body;

a connected element having two ends, one end thereof connected to a top of the body and contacted with an inner edge of the hook element, the connected element having a pivotal shaft pivoted on the top of the body and contacted with an inner edge of the hook element;

a puller connected to the connected element; and buckled means disposed between the body and the puller for buckling and fixing the puller on the body.

2. The zipper head as claimed in claim 1, wherein the body has a baffler disposed between the two guiding grooves for separating the guiding grooves.

3. The zipper head as claimed in claim 1, wherein the body has a receiving space and a through hole for receiving the hook element, and the hook portion of the hook element is received in the through hole.

4. The zipper head as claimed in claim 1, wherein the top of the body has two protruding pivotal seats, and the pivotal shaft of the connected element is pivoted on the pivotal seat of the top of the body.

5. The zipper head as claimed in claim 1, wherein the connected element has a first pin hole at another end thereof, and the puller has a second pin hole at one end thereof, a pin element disposed through the first pin hole and the second pin hole, for pivoting the puller on the one end of the connected element.

6. The zipper head as claimed in claim 1, wherein the puller has a word, a pattern or a trademark arranged thereon.

7. The zipper head with puller fixed function as claimed in claim 1, wherein the buckled means has a buckled body disposed on the one end of the body and a buckled hole oppositely disposed on the one end of the puller, and the buckled body and the buckled hole are buckled each other.

8. A zipper head with a puller fixed function comprising:

a body having two guiding grooves;

a hook element disposed on the body, and the hook element having a hook portion at an end thereof and inserted into the guiding groove of the body;

a connected element having two ends, one end thereof connected to a top of the body and contacted with an inner edge of the hook element;

a puller connected to the connected element; and buckled means disposed between the body and the puller for buckling and fixing the puller on the body, the buckled means having a buckled body disposed on the one end of the body and a buckled hole oppositely disposed on the one end of the puller, and the buckled body and the buckled hole are buckled each other.

9. A zipper head with puller fixed function comprising:

a body having two guiding grooves;

a hook element disposed on the body and the hook element having a hook portion at an end thereof and inserted into the guiding groove of the body;

a connected element having two ends, one end thereof connected to a top of the body and contacted with an inner edge of the hook element;

a puller connected to the connected element; and buckled means disposed between the body and the puller for buckling and fixing the puller on the body, the buckled means having a first projecting buckle disposed on the one end of the body and a second oppositely projecting buckle disposed on the one end of the puller, and the first projecting buckle and the second projecting are buckle buckled each other.

* * * * *